US008979723B2

(12) United States Patent
Tarka

(10) Patent No.: US 8,979,723 B2
(45) Date of Patent: Mar. 17, 2015

(54) FLAT PRESSER

(76) Inventor: Michael P. Tarka, Agawam, MA (US)

( * ) Notice: Subject to any disclaimer, the term of this patent is extended or adjusted under 35 U.S.C. 154(b) by 674 days.

(21) Appl. No.: 13/252,319

(22) Filed: Oct. 4, 2011

(65) Prior Publication Data

US 2012/0088644 A1 Apr. 12, 2012

Related U.S. Application Data

(60) Provisional application No. 61/391,318, filed on Oct. 8, 2010.

(51) Int. Cl.

| | |
|---|---|
| ***B26D 7/18*** | (2006.01) |
| ***B31B 1/14*** | (2006.01) |
| *B26D 7/02* | (2006.01) |

(52) U.S. Cl.

CPC ..... *B31B 1/14* (2013.01); *B26D 7/1818* (2013.01); *B26D 7/025* (2013.01); *B26D 2007/189* (2013.01); *B31B 2201/02* (2013.01); *B31B 2201/22* (2013.01)

USPC ..... 493/82; 493/373; 493/474; 225/103

(58) Field of Classification Search

CPC ..... B65H 35/00; B65H 35/10; B31B 1/14; B26D 7/02; B26D 7/18; B26D 7/00; B26D 7/025; B26D 7/1818; B23P 11/00; B31F 1/40; B31F 3/02; B30B 9/321; B30B 9/3014; B30B 15/34

USPC ..... 493/468, 82–83, 472, 480, 342; 83/175; 225/103–106, 96; 100/214, 218, 92

See application file for complete search history.

(56) References Cited

U.S. PATENT DOCUMENTS

| | | | | | |
|---|---|---|---|---|---|
| 3,465,634 | A * | 9/1969 | Blais | 83/695 |
| 5,065,926 | A * | 11/1991 | Yerly | 225/93 |
| 5,109,763 | A * | 5/1992 | Morris et al. | 100/48 |
| 5,355,789 | A * | 10/1994 | Suzuki et al. | 100/92 |
| 5,372,063 | A * | 12/1994 | Berg | 100/110 |
| 5,529,565 | A * | 6/1996 | Oetlinger | 493/468 |
| 5,766,123 | A * | 6/1998 | Oetlinger | 493/468 |
| 6,032,847 | A * | 3/2000 | Ehmig et al. | 227/10 |
| 6,589,148 | B2 * | 7/2003 | Tarka | 493/373 |
| 6,959,643 | B1 * | 11/2005 | Sammons et al. | 100/226 |
| 7,536,949 | B2 * | 5/2009 | Skannerup | 100/269.18 |
| 2009/0179037 | A1 * | 7/2009 | Spivey et al. | 220/729 |
| 2011/0132956 | A1 * | 6/2011 | Kempka, Jr. | 225/103 |

* cited by examiner

*Primary Examiner* — Thanh Truong
*Assistant Examiner* — Justin Citrin
(74) *Attorney, Agent, or Firm* — McCormick, Paulding & Huber LLP

(57) ABSTRACT

A flat presser for supporting blanking material during operation of a blanking tool for making packaging blanks includes a plurality of coaxially oriented, concentric wall sections of progressively different interior areas and being collapsible from an extended position wherein the wall sections partially overlap in an axial direction to a collapsed position wherein the wall sections substantially completely overlap in the axial direction, and a biasing mechanism for biasing the wall sections to the extended position.

4 Claims, 15 Drawing Sheets

FLAT PRESSER

CROSS REFERENCE TO RELATED APPLICATIONS

This application claims the benefit of U.S. Provisional Application Ser. No. 61/391,318, filed on Oct. 8, 2010, which is herein incorporated by reference in its entirety.

FIELD OF THE INVENTION

The present invention relates to a blanking tool for making packaging and carton blanks and, more particularly, to a flat presser for supporting blanking scrap material during operation of the blanking tool.

BACKGROUND OF THE INVENTION

In the manufacture of cartons during a blanking operation, small sheets of paper material having specific profiles are cut out of larger sheets of paper material. These smaller sheets are known as carton blanks which are later formed into cartons and/or boxes.

As shown in FIGS. 1 and 2, in a die cutting machine 10, the blanks are cut, but not removed from a large sheet 12 of paper material. After the blanks have been cut at a cutting station 14, the large sheet layout 12 is pulled into a stripping station 15, where small pieces of waste in between the blanks are removed, and then to the blanking station 16 where the sheet is positioned over a frame which includes openings which correspond in size, shape and position to the profile of the carton blank layout.

At the blanking station 16, an upper tool is used in combination with the lower frame to knock the carton blanks from the sheet of paper material while holding the scrap material that surrounds the blanks. In particular, as shown in FIG. 3, a male blanker 20 includes a plurality of presser members 22A, 22B, 22C, 22D, 22E secured to a support plate/board 24, and the presser members 22A-22E are dimensioned to be the same shape and slightly smaller than the blanks 26A, 26B, 26C, 26D, 26E of a large sheet 12 supported upon a female blanker 28. Next to and between the presser members 22A-22E are a plurality of prior art standard pressers having presser rails 30. (Only one of the identical six illustrated presser rails in FIG. 3 is identified by the reference number 30 to avoid confusion.) Each prior art flat presser includes two mount housings 32, 34 that secure the presser rail 30 to the support plate 24. Each mount housing 32, 34 includes a guide strut 36, 38 that is secured within the mount housing by a spring biasing mechanism such as a captured coil spring (not shown), and the guide struts 36, 38 are secured to the presser rail 30. The spring biasing mechanism forces the presser rail 30 in a direction away from the support plate 24 and mount housings 32, 34.

As is well known, in operation the support plate 24 is moved against the sheet 12 as shown in FIG. 4 so that the presser rail 30 secures and stabilizes the carton blank scrap surrounding the blanks as the presser members 22A-22E impact the blanks 26A-26E to force them to break apart from the large sheet 12 and move with gravity assistance and guided by stationary joggers (not shown) to blank stacking piles 40A, 40B, 40C, 40D, 40E. After the blanks 26A-26E are removed from the large sheet 12, the sheet is referred to as blanking scrap. As is apparent, the faster the large sheet 12 can be processed by the male and female blankers 20, 28, the more cost efficient the blanking operation becomes.

As discussed above, in order to securely hold the carton blank scrap, known presser rails are interconnected to the support plate 24 by mount housings 32, 34 and guide struts 36, 38. As shown in FIGS. 3 and 4, each guide cylinder 32, 34 biases the presser rail 30 downwardly away from the support plate 24, and are mounted to the support plate 24 such that the mount housings 32, 34 project upwardly from the support plate. 24. However, it is desirable to eliminate any components projecting above the support plate 24 and instead provide interior mounted flat pressers/presser assemblies for a number of reasons. First, for tool storage purposes, an upper tool having interior mounted pressers takes up less space. This is particularly advantageous in locations where storage space is limited. Secondly, many existing die cutting machines are built in such a manner that the upper tool slides into the blanking station of the machine. Any component projecting upwardly from the support plate would interfere with such sliding action. Therefore, only interior mounted flat pressers can be used with such systems.

In addition, during the cutting operation, perimeters of the blanks are cut out using a continuous steel knife configuration of the blank profile. The blanks are usually held in the sheet 12 with nicks. Nicks are small areas around the perimeter where the knife is removed, usually with a small grinding wheel or chisel. Multiple nicks are usually placed around the blanks to carry the sheet into the blanking station 16 where the nicks are pulled apart during the blanking cycle. As the machine speed increases, more nicks may have to be added to the existing cutting tool to help hold the blanks in place. More nicks may hold the sheet together but they can also cause problems when the sheet is transferred to the blanking station 16. Therefore, it is desirable for a machine operator to have the ability to easily add a flat presser to the support plate 24 while the board is still on press. Prior art pressers, however, make it difficult to add pressers onto a support board without cutting a custom profile into the support plate 24 for mounting. In addition, prior art pressers are usually large, not customizable, and there is often insufficient space on the support plate for mounting any additional pressers to increase support and stabilization of the carton blank scrap during the blanking operation. In particular, known presser assemblies are often arranged in static rows, which allow for limited, if any, customization of presser geometry, i.e., the arrangement of pressers on the support plate.

SUMMARY OF THE INVENTION

In view of the foregoing, it is an object of the present invention to provide a flat presser for supporting blanking scrap material during operation of a blanking tool for making packaging blanks.

It is another object of the present invention to provide a flat presser that is surface mountable with a support board of a blanking tool.

It is another object of the present invention to provide a flat presser that is easy to assembly, inexpensive to manufacture and that utilizes strong materials with low friction.

It is another object of the present invention to provide a flat presser that is easy to mount to standard blanking operation machinery.

It is another object of the present invention to provide a flat presser that provides consistent pressure to the blank scrap throughout the blanking operation.

It is another object of the present invention to provide a flat presser that is small in size and which can be positioned almost anywhere on the support board.

It is another object of the present invention to provide a flat presser that can easily be utilized in combination with a presser rail to provide a linear pressing surface.

In accordance with an embodiment of the present invention, a flat presser includes a plurality of coaxially oriented, concentric wall sections of progressively different interior areas and being collapsible from an extended position wherein the wall sections partially overlap in an axial direction to a collapsed position wherein the wall sections substantially completely overlap in the axial direction, and a biasing mechanism for biasing the wall sections to the extended position.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
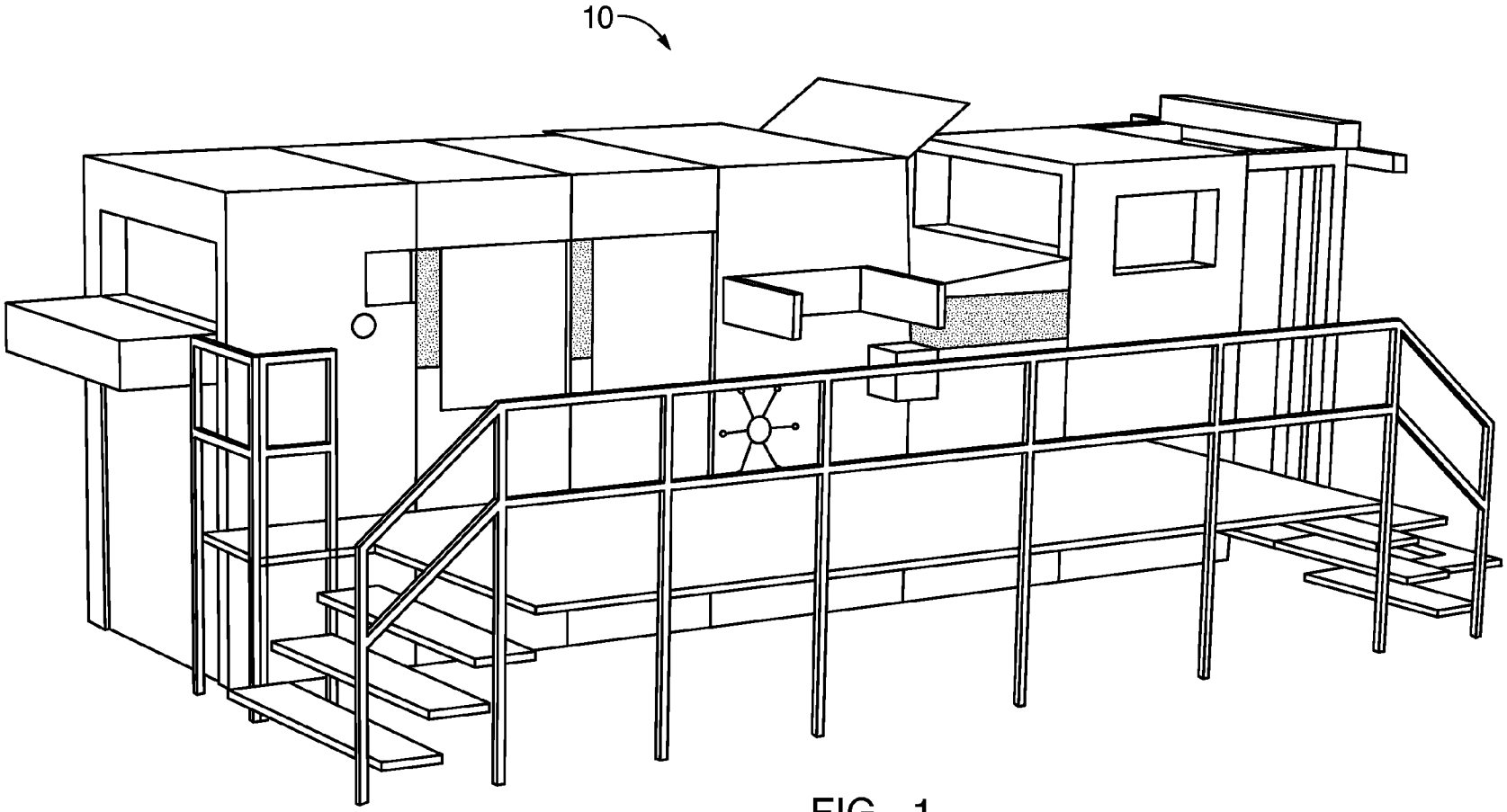
FIG. 1 Prior Art
FIG. 1 is a perspective view of a prior art die cutting machine for manufacturing carton blanks.
Figure 2:
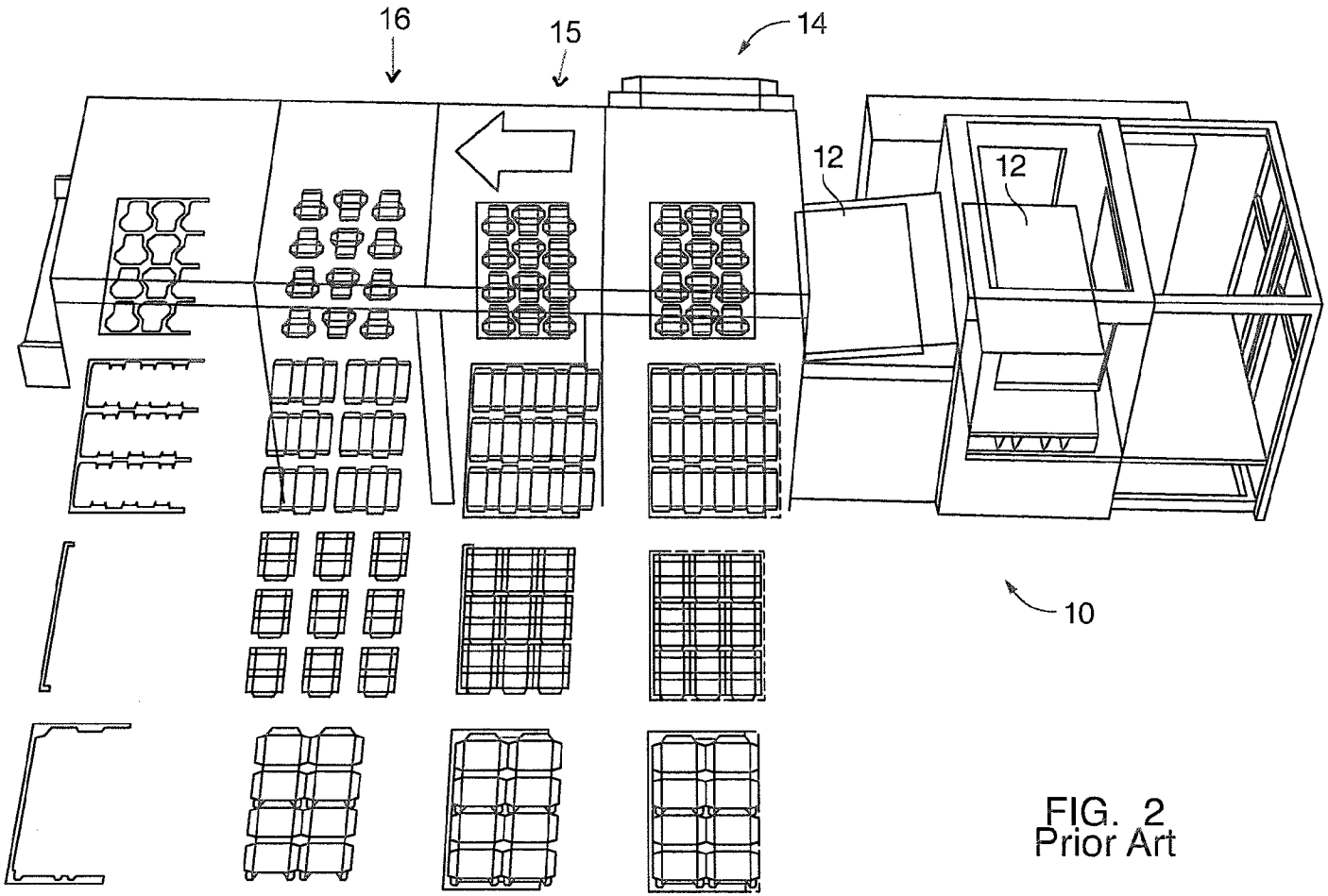
FIG. 2 Prior Art
FIG. 2 is a schematic illustration of the interior of the prior art die cutting machine of FIG. 1 showing cutting station and a blanking station.

Referring now to the drawings, FIGS. 5-8 illustrate a flat presser 100 for use with a male blanker of a die cutting machine for converting or processing a sheet of paper material into a carton blank. These machines are well known in the art and are used to cut one or several blanks into each sheet of paper material which, after folding and gluing, may be formed into cartons or boxes. As is conventional, the sheets of paper material within the machine are carried through various sequences of printing, cutting, embossing, creasing, waste stripping and/or blank stations.

Figure 5:
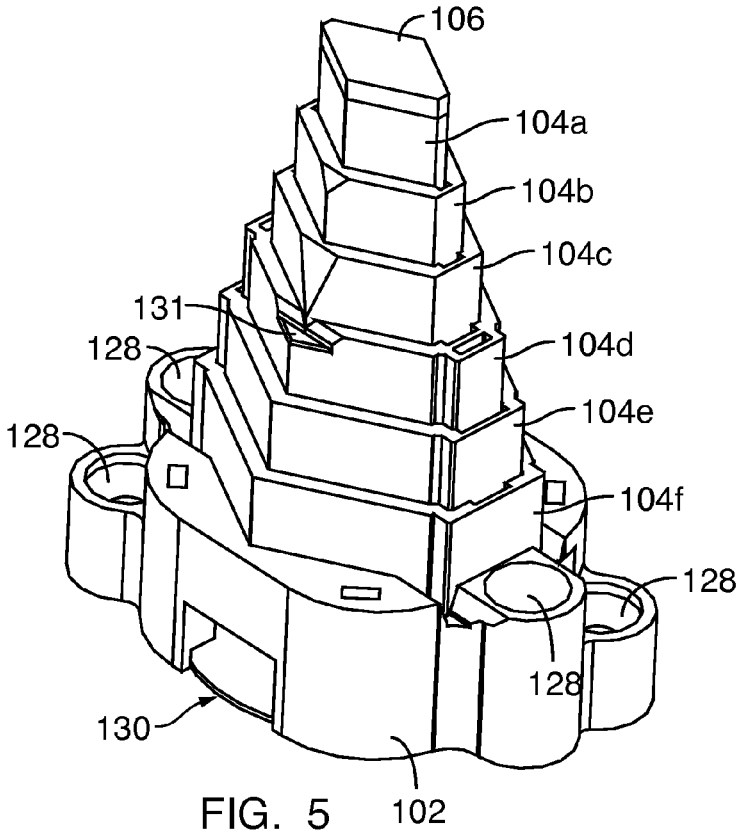
FIG. 5 is a perspective view of a flat presser for use with a male blanker of a die cutting machine in accordance the present invention, shown in an extending position.
Figure 8:
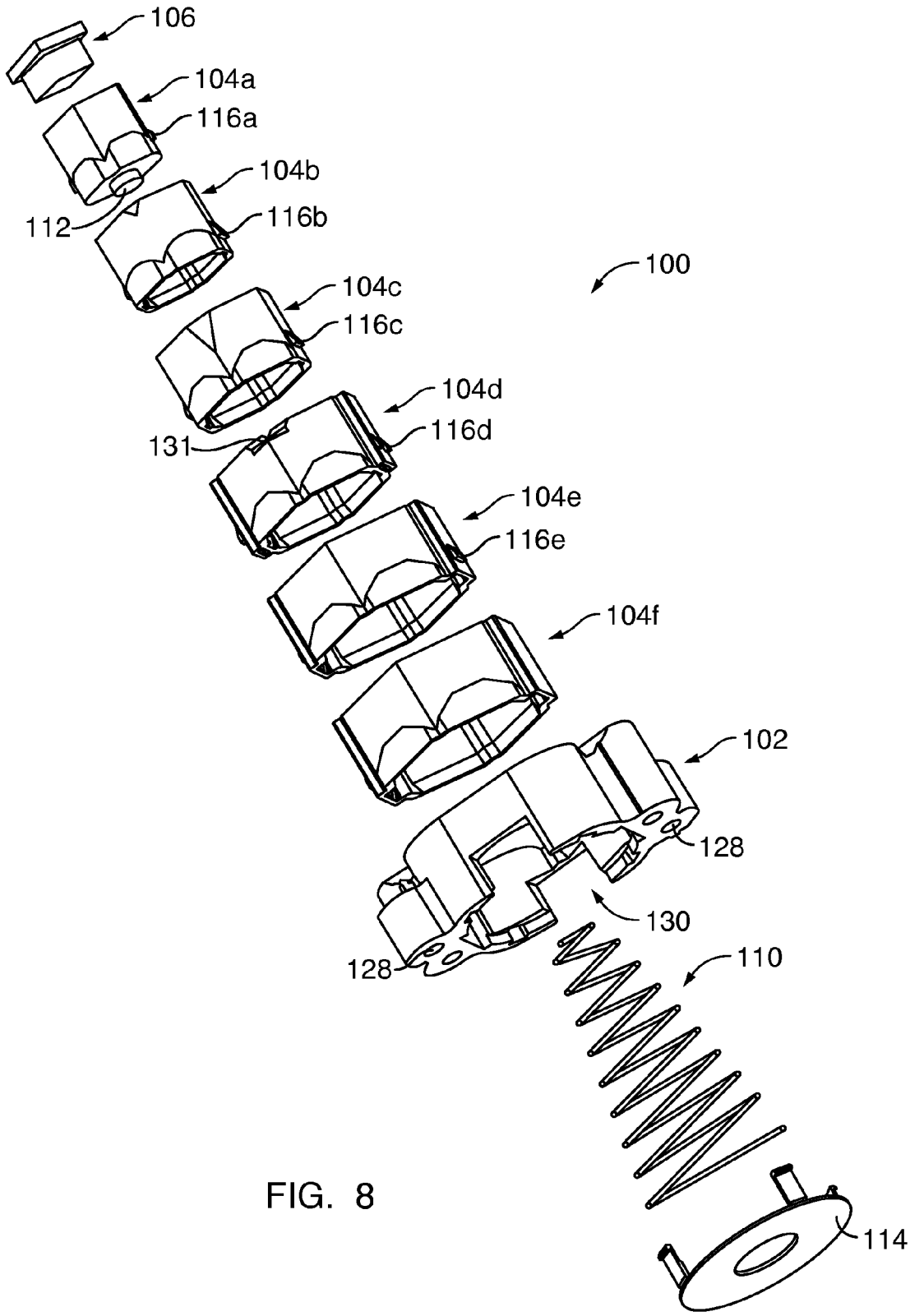
FIG. 8 is an exploded perspective view of the flat presser of FIG. 5.
Figure 9:
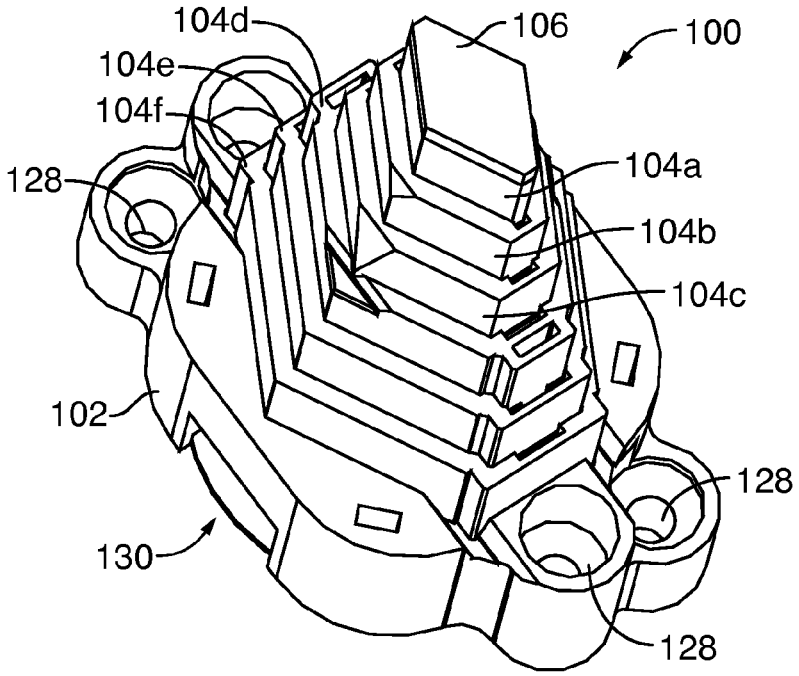
FIG. 9 is a perspective view of the flat presser of FIG. 5 shown in a partially collapsed position.
Figure 10:
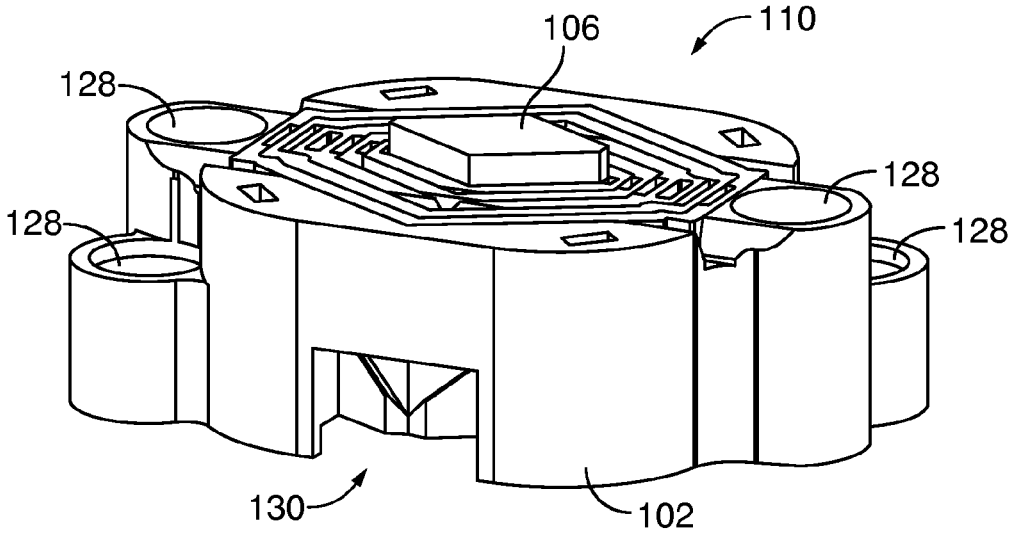
FIG. 10 is a perspective view of the flat presser of FIG. 5 shown in a fully-collapsed position.
Figure 11:
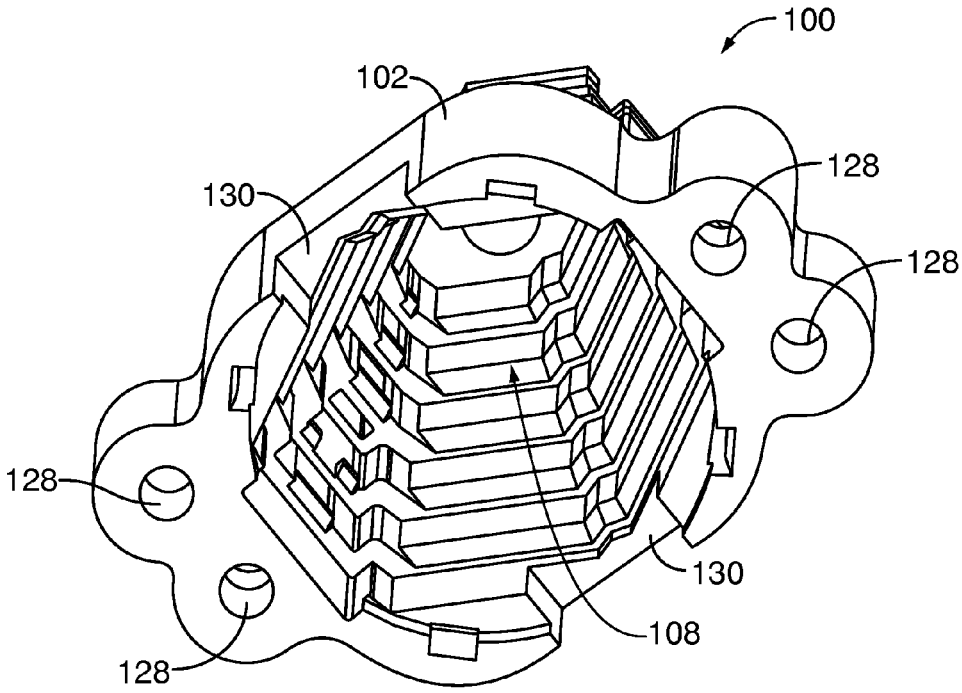
FIG. 11 is a bottom perspective view of the flat presser of FIG. 5 in a partially collapsed position.
Figure 12:
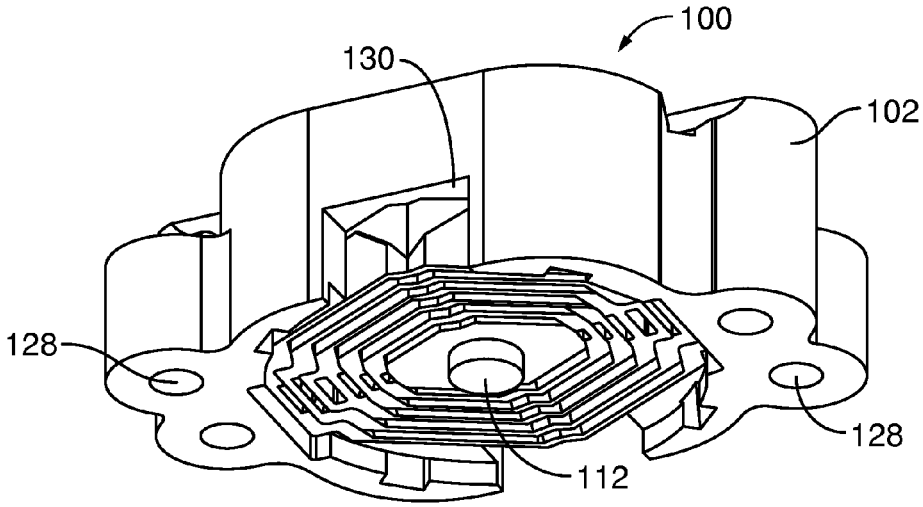
FIG. 12 is a bottom perspective view of the flat presser of FIG. 5 in a fully-collapsed position.

As shown in FIG. 5, the flat presser 100 includes a base 102 and plurality of coaxially oriented, concentric wall sections 104*a-f*, each wall section generally taking the shape of a rhombus or diamond and having progressively different diagonal lengths (and different inner areas). FIG. 8 shows an exploded view of the flat presser including the base 102 and six wall sections 104*a-f*, although the invention may include more or fewer wall sections without departing from the broader aspects of the present invention. The wall sections 104*a-f* are nested within one another and are collapsible from an extended position (FIGS. 5 and 6) wherein the wall sections 104*a-f* partially overlap in the axial direction to a collapsed position (FIGS. 10 and 12) wherein the walls sections 104*a-f* substantially completely overlap in the axial direction. FIGS. 9 and 11 illustrates the flat presser 100 in an intermediate, partially collapsed position. As best shown in FIGS. 10 and 12, in the fully collapsed position, the sidewall sections 104*a-f* are all housed within the diamond shaped opening in the base 102 such that the full height of the flat presser 100 is substantially equal to the height of the base 102. An elastomeric cap 106 having a substantially planar surface is received in the smallest wall section 104*a*. In the preferred embodiment, the elastomeric cap 106 may be made of rubber or like material having a coefficient of friction high enough to grip and hold the sheet of material during the blanking operation, as discussed in detail below.

Figure 7:
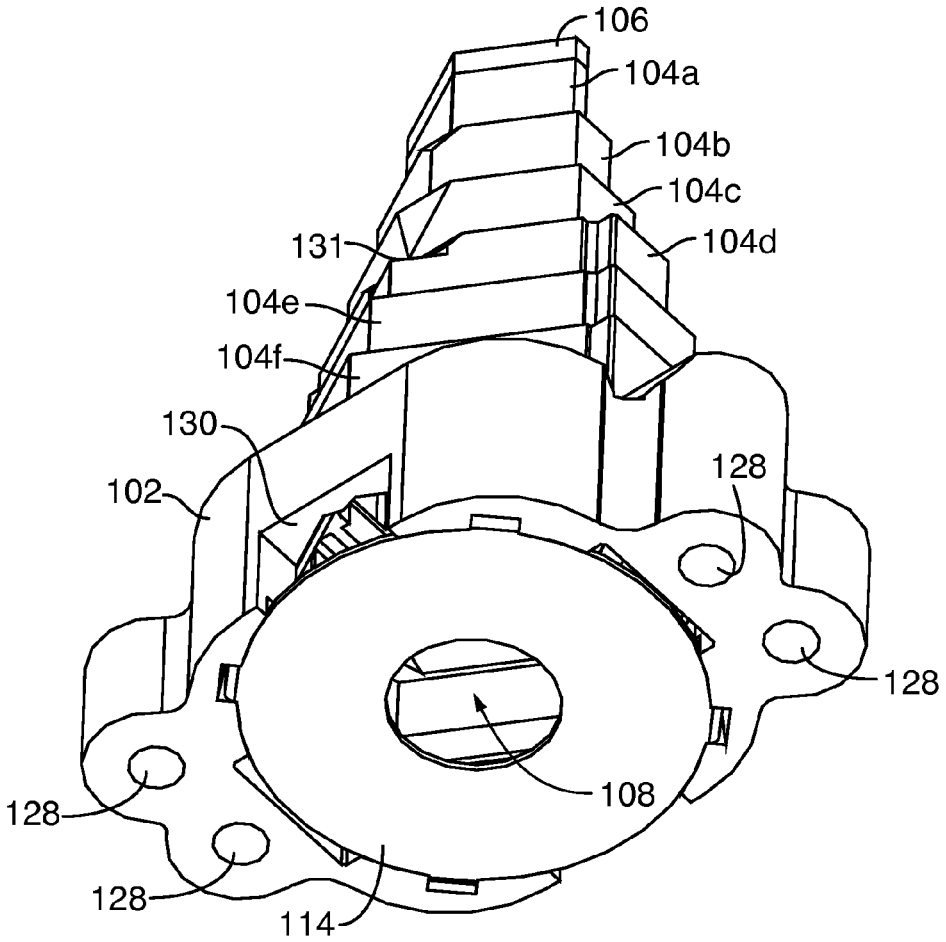
FIG. 7 is a bottom perspective view of the flat presser of FIG. 5.

As best shown in FIGS. 7 and 11, in the extended position, the flat presser 100 defines a generally open cavity 108 in the bottom thereof. A conical spring 110 is housed within the cavity 108. The conical spring 110 is positioned generally coaxially with the wall sections 104*a-f* within the cavity 108. The spring 110 is retained in place within the cavity 108 by a locating protrusion 112 formed in the underside of sidewall section 104*a* that is received by a small diameter end of the spring 110, and by a locking plate 114 secured to the base 102. Importantly, the spring 110 biases the flat presser 100 to its extended position, i.e., it biases wall sections 104*a-f* away from the base 102 when the spring 110 is retained within the cavity 108. As shown in FIG. 8, locking plate 114 has a plurality of legs that engage complimentary recesses in the base to secure the locking plate 114 to the base. The locking plate 114 may also be secured to the base 102 by other means known in the art, such as by fasteners, adhesive and the like, without departing from the broader aspects of the present invention.

Figure 13:
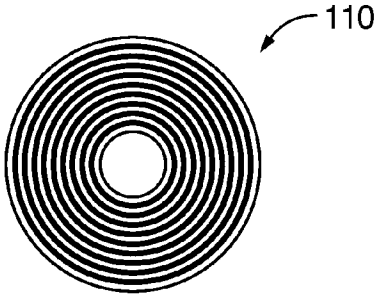
FIG. 13 is a top plan view of a conical spring for use in the flat presser of FIG. 5.
Figure 14:
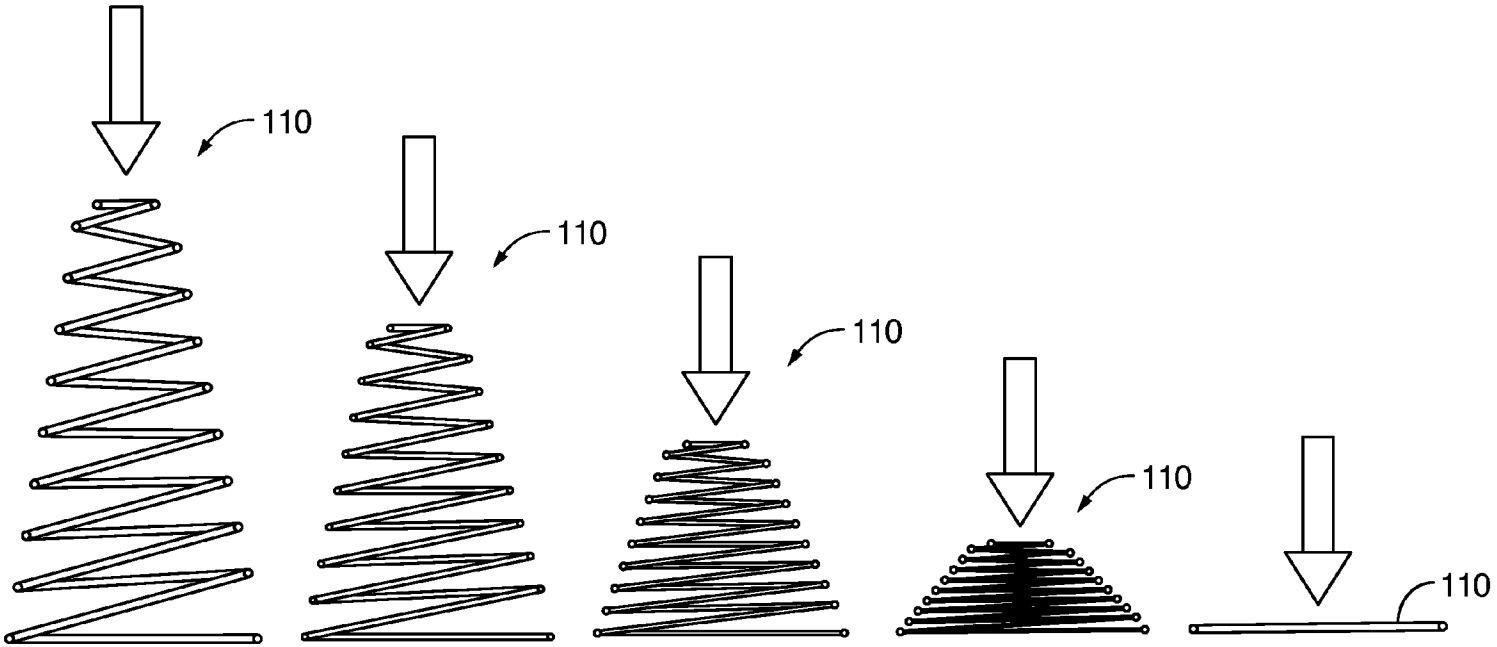
FIG. 14 is a front elevational view of the conical spring of FIG. 13 illustrating movement of the spring under applied load.

FIGS. 13 and 14 illustrate the configuration of the conical spring 110. As shown therein, the spring has a small diameter end and a large diameter base. As force is applied to the small diameter end of the spring 110, the spring collapses to a substantially flat configuration (see right-most drawing of FIG. 14). This position of the spring 110 corresponds to the fully-collapsed position of the flat presser 100.

Figure 15:
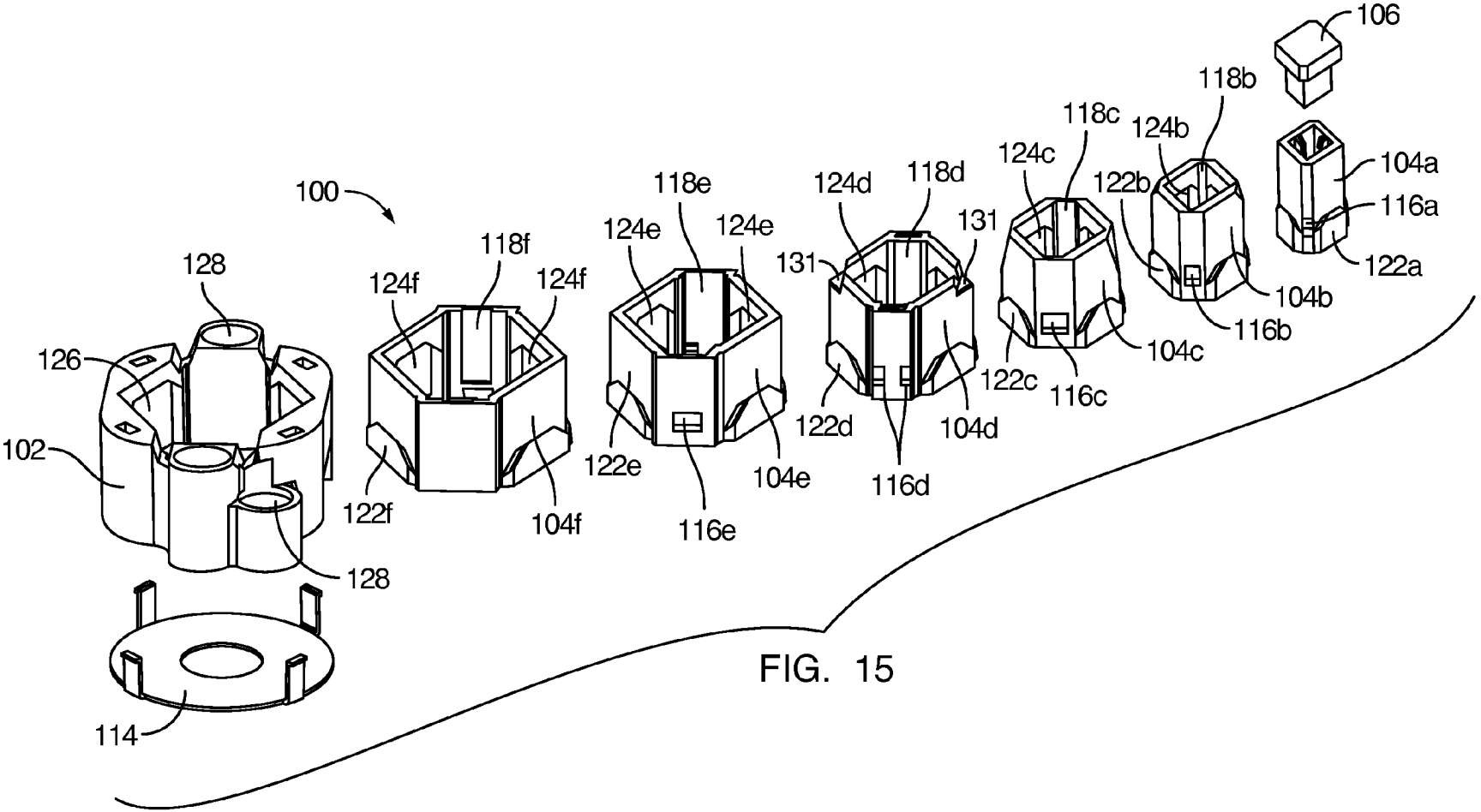
FIG. 15 is a top perspective, exploded view of the flat presser of FIG. 5 illustrating position stops.
Figure 16:
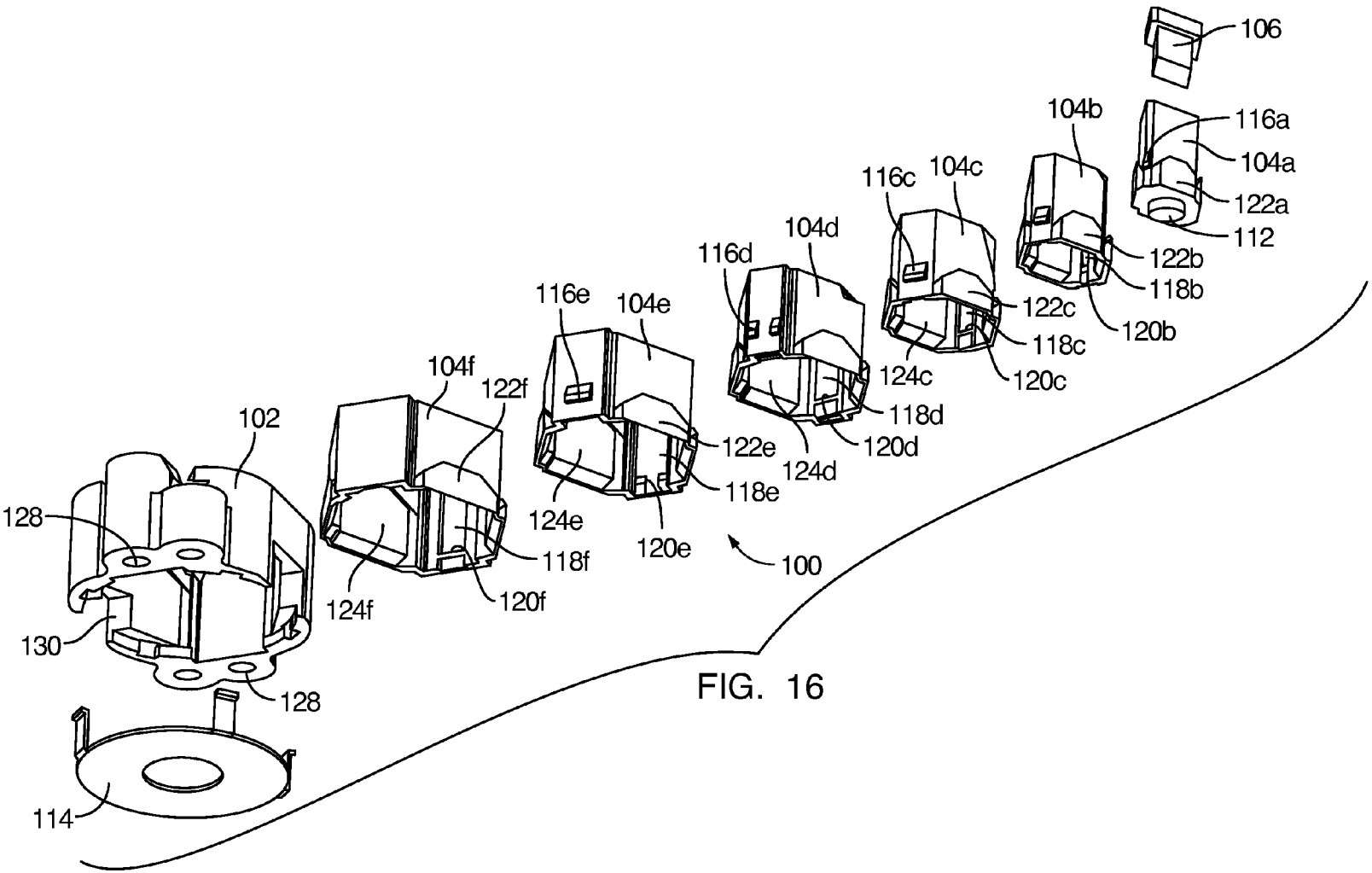
FIG. 16 is a bottom perspective, exploded view of the flat presser of FIG. 5 illustrating position stops.

Referring to FIGS. 8, 15 and 16, assembly of the flat presser 100 will now be discussed. During assembly, wall section 104*a* may first be inserted through the bottom of wall section 104*b*. Once wall section 104*a* is nested within wall section 104*b*, wall section 104*b* can be nested in the same manner within wall section 104*c*, and so on. Finally, wall section 104*f* can be inserted through the bottom of base 102 in a similar manner such that all wall sections 104*a-f* are in a nested configuration. In this extended configuration, the conical spring 110 may then be inserted into cavity 108 and retained in place by locking plate 114, as discussed above. Elastomeric cap 106 may be inserted into wall section 104*a* either first, or after the flat presser 100 is assembled. Importantly, locking plate 114 provides a flat surface on the bottom of the flat presser 100, allowing the flat presser 100 to be surface mounted to the bottom of a support board, such as support plate 24 of male blanker 20 of FIGS. 3 and 4.

With further reference to FIGS. 15 and 16, the specific configuration of the wall sections 104*a-f* is shown. As shown therein, wall sections 104*a-e* each have a pair of protrusions 116*a-e* on opposing outer walls thereof. The protrusions 116*a-e* are angled downward and terminate in outwardly extending shoulders (shoulders extend substantially perpendicular from outer walls of wall sections 104*a-e*). In addition, wall sections 104*b-f* each have a pair of channels or grooves 118*b-f* on opposing inner walls thereof. The channels 118*b-f* are sized to slidingly receive complimentary protrusions 116*a-e* therein. For example, opposing channels 118*b* in the inner walls of wall section 104*b* are sized to slidably receive opposing protrusions 116*a* of wall section 104*a*. Likewise, opposing channels 118*e* in the inner walls of wall section 104*e* are sized to slidably receive opposing protrusions 116*d* on wall section 104*d*.

As further shown in FIGS. 15 and 16, each of the channels 118*b-f* has an abutment 120*b-f* adjacent the bottom thereof. Each abutment is sized and positioned so as to be complimentary with the shoulders of protrusions 116*a-e* on wall sections 104*a-e*. During assembly, for example, wall section 104*a* is inserted through the bottom of wall section 104*b*. The angled portion of the protrusions 116*a* of wall section 104*a* permit the protrusions 116*a* to slide past abutments 120*b* and into channels 118*b* such that wall section 104*a* is received within wall section 104*b*. Once received, wall section 104*a* cannot be retracted from wall section 104*b* because of the abutments 120*b* on the inner walls of wall section 104*b*. In particular, any attempt to retract wall section 104*a* (in a collapsed direction) from wall section 104*b* causes the shoulder of protrusions 116*a* to come into contact with abutments 120*b*. In this respect, downwards movement of wall section 104*a* with respect to wall section 104*b* is directly limited by abutments 120*b* on the inner walls of wall section 104*b*.

As further shown therein, each wall section 104*a-f* includes a plurality of raised surfaces 122*a-f* on the outer walls thereof adjacent the bottom walls thereof. These surfaces 122*a-f* are complimentary in size and shape to relieved portions 124*b-f* in the inner walls of wall sections 104*b-f*. When, for example, wall section 104*e* is inserted into the bottom of wall section 104*f*, upward movement of wall section 104*e* with respect to wall section 104*f* is limited by the length of relieved portion 122*f*. In particular, raised surface 122*e* is slidably received in relieved portion 124*f* and is limited in its upward travel by the extent of relieved portion 124, i.e., raised surface 122*e* eventually abuts the end of the relieved portion 124*f*. As will be readily appreciated, base 102 also has relieved portions 126 on inner walls thereof that are sized and shaped so as to slidably receive raised surfaces 122*f* of wall section 104*f*, thereby limiting upwards movement of wall section 104*f* with respect to the base 102.

Importantly, the contact between the shoulders of protrusions 116*a-e* with abutments 120*b-f* prevents each wall section 104*a-f* from being removed (in a collapsed/retracted direction) from the wall section 104*a-f* within which it is nested. Likewise, the contact between the raised surfaces 122*a-f* and the ends of the relieved portions 124*b-f*, 126 prevents each wall section 104*a-f* from being removed (in an extended/expanded direction) from the wall section 104*a-f* (or base 102) within which it is nested.

Referring back to FIGS. 5 and 6, base 102 includes a plurality of mounting throughbores 128. In the preferred embodiment, there are four mounting throughbores in the base 102, although more or fewer throughbores may be utilized without departing from the broader embodiments of the present invention. As will be readily appreciated, the flat presser 100 may be secured to the bottom of a support board of a male blanker, such as support plate 24 of male blanker 20, shown in FIGS. 3 and 4, by screws or the like.

Figure 6:
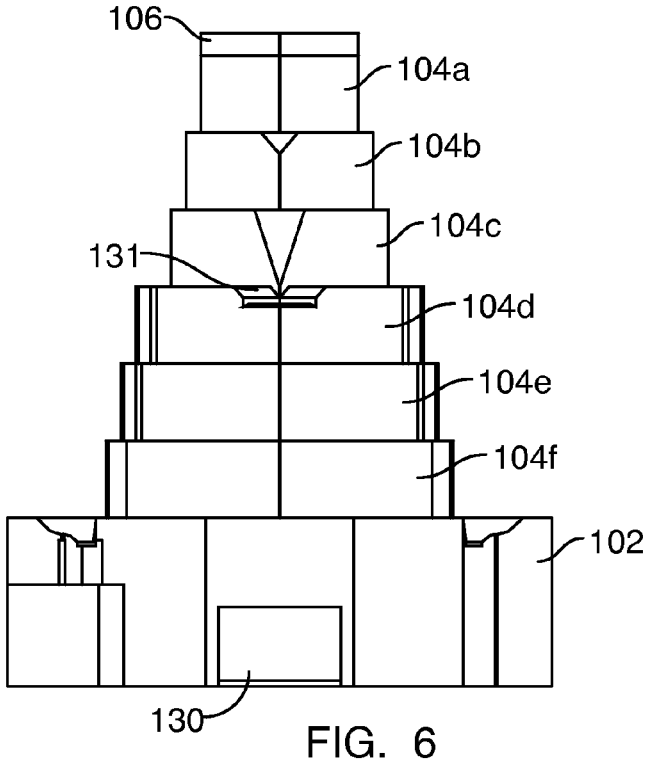
FIG. 6 is a front elevational view of the flat presser of FIG. 5.

As further shown in FIGS. 5 and 6, the base 102 includes a pair of vent holes 130 in the sidewall thereof, which facilitate smooth operation of the flat presser 100. In particular, during operation, the compression of the conical spring may create a slight pressure differential within the cavity 108 of the flat presser 100 itself, and therefore vent apertures 130 formed in the housing allow for venting and the quick and smooth action of the flat presser 100.

In an embodiment, one or more of the wall sections 104*a-f* includes a notch 131 or cutout which provides a clearance for the presser members 22A-E in situations where the flat presser 100 may be mounted in close association with the presser members 22A-E.

In the preferred embodiment, the flat presser 100 is approximately 2½ inches tall from base to the tip of the elastomeric member 106 in the fully extended position, and collapses to approximately ⅝ inches tall. In addition, in the preferred embodiment, the flat presser 100 has a major width of approximately 2 inches and a minor width of approximately 1 inch. Moreover, the wall sections 104*a-f* and the base 102 are preferably formed from a suitably durable material having a suitably low coefficient of friction, such as plastic including, but not limited to, polyethylene and the like.

As will be readily appreciated, the flat presser 100 of the present invention is easy to assemble, inexpensive to manufacture and is formed from lasting materials with a low or very low coefficient of friction. As will be readily appreciated, this provides for a long lasting, lower cost flat presser 100.

Figure 3:
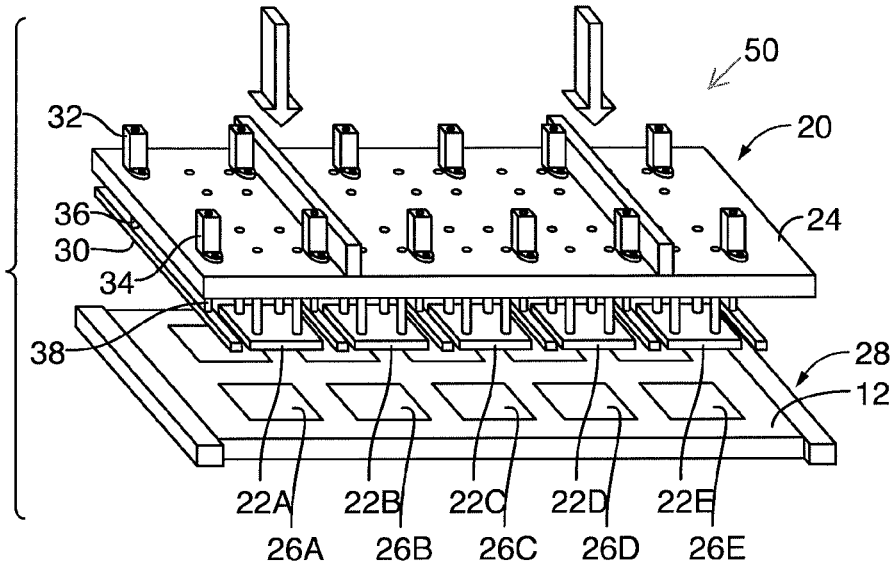
FIG. 3 Prior Art
FIG. 3 is a partial perspective view of a prior art male blanker and female blanker cooperatively positioned to knock blanks out of a large sheet of packaging material.
Figure 4:
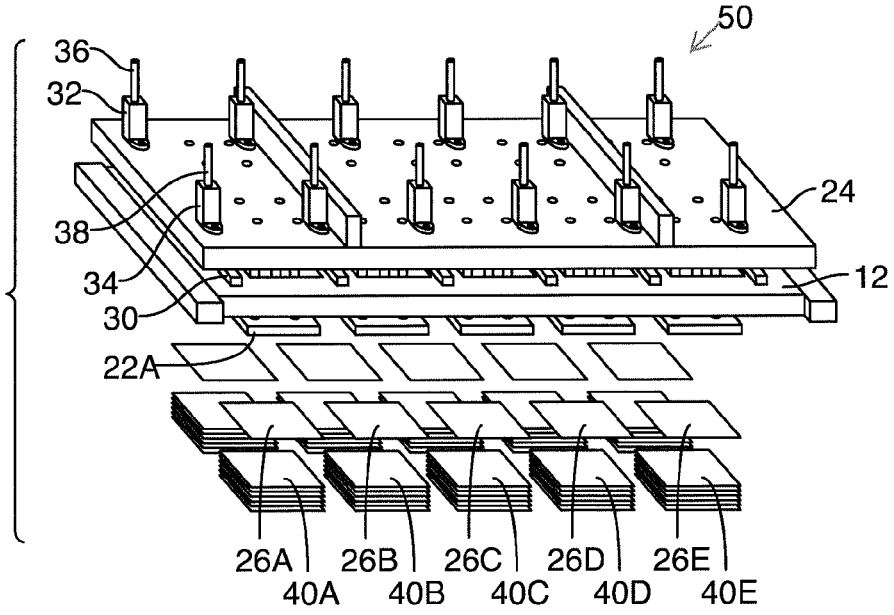
FIG. 4 Prior Art
FIG. 4 is a partial perspective view of the FIG. 3 prior art male and female blanker showing usage of a prior art presser rail in knocking out packaging blanks.

With reference to FIGS. 3, 4 and 5, in operation, a plurality of flat pressers 100 are surface mounted to the bottom of a support plate 24 of a blanking tool 50 in predetermined locations (they are utilized in place of presser rails 30 and mount housings 32, 34). Under the bias of the conical spring 110, the flat pressers 100 are each in a fully extended position. As the male blanker 20, and thus the support plate 24, move downwardly, flat pressers 100 engage the top surface of the sheet 12 of paper material and retract/collapse, as previously described, to hold the scrap. The presser members 22A-E then push the blanks 26A-E from the sheet 12, and thereafter, the male blanker 20, including support plate 24 then moves upwardly to its initial starting position where the flat pressers 100 again return to their fully extended positions.

Notably, during downward movement of the blanking tool, it is necessary to securely stabilize the carton blank scrap surrounding the blanks by frictionally holding the scrap with the plurality of flat pressers 100 positioned around the carton blanks throughout the layout. The spring 110 in the flat presser 100 allows for consistent pressure applied to the blank scrap throughout the complete vertical motion of the support board during the blanking cycle.

As discussed above, the utilization of a conical spring that compresses to a completely flat configuration, as shown in FIG. 14, allows the flat presser 100 to fully collapse (see FIG. 10), thereby providing a minimum protrusion distance from the lower surface of the support board 24. Notably, the design of the flat presser 100 allows for quick and easy surface mounting to the underside of the support board 24 using screws or other suitable fastening means. In addition, the small size of the flat presser 100 allows it to be quickly and easily mounted to the support board 24 in almost any location, thereby allowing for a level of customization of presser arrangement heretofore unseen in the art. In particular, as a result of the small size and quick mounting capabilities of the flat presser 100, flat pressers 100 can be quickly and easily mounted at almost any location on the support board 24 by an operator without substantial down-time, thereby providing a precise, pointed stabilization of the sheet of material that is simply not possible with prior art presser devices. In contrast to the present invention, there often will not exist sufficient space on the support board for additional conventional presser assemblies.

Turning now to FIGS. 17-21, an alternative embodiment of the present invention is shown. As shown therein, in an embodiment, a flat presser rail assembly 200 utilizes flat pressers 100 in combination with presser rails to achieve a pressing arrangement substantially similar to that achieved by the presser rails 30 and mount housings 32, 34 known in the art, but which also provides the advantages hereinbefore disclosed.

Figure 17:
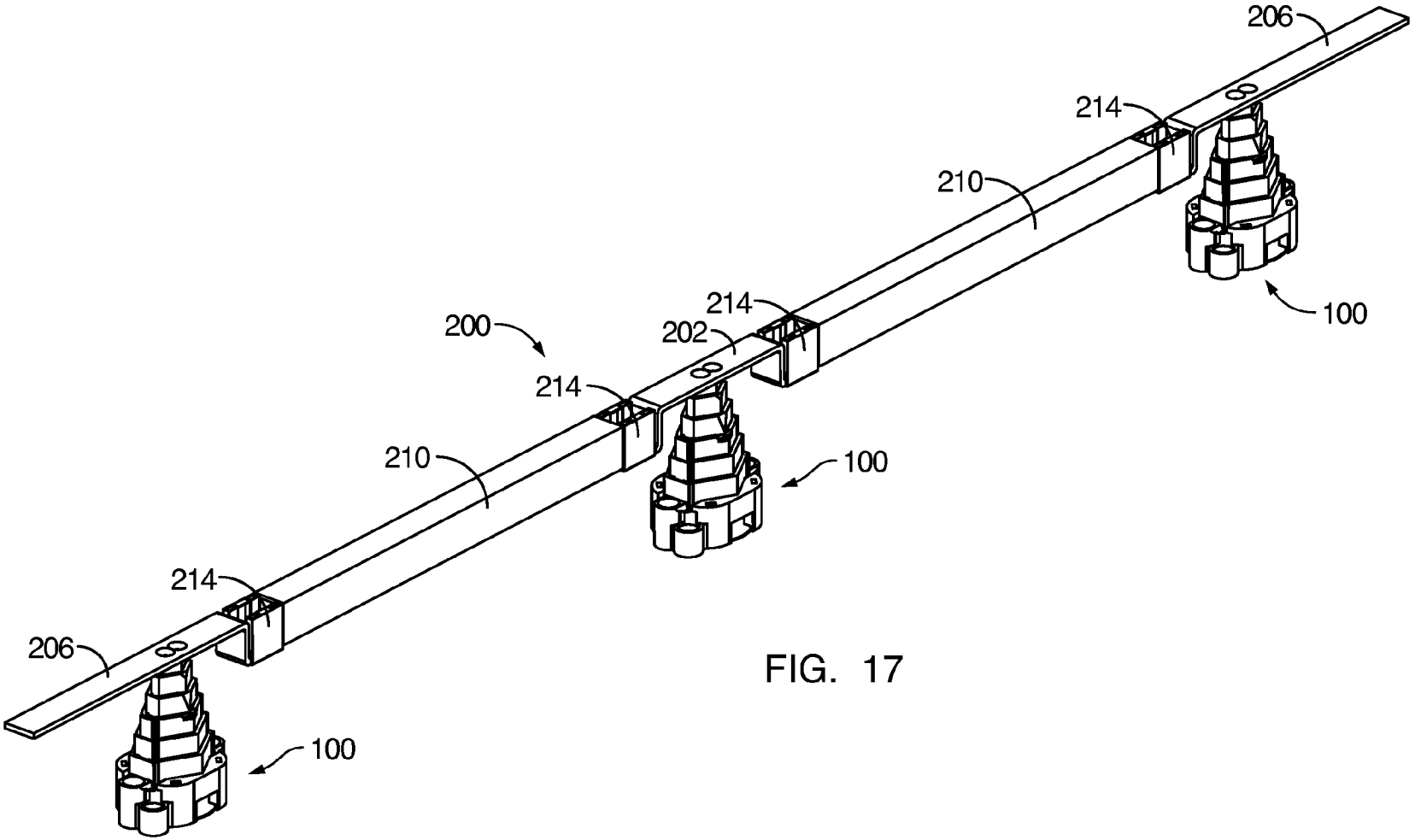
FIG. 17 is a perspective view of a flat presser rail assembly utilizing a plurality of the flat pressers of FIG. 5 and a presser rail in accordance with another embodiment of the present invention.
Figure 18:
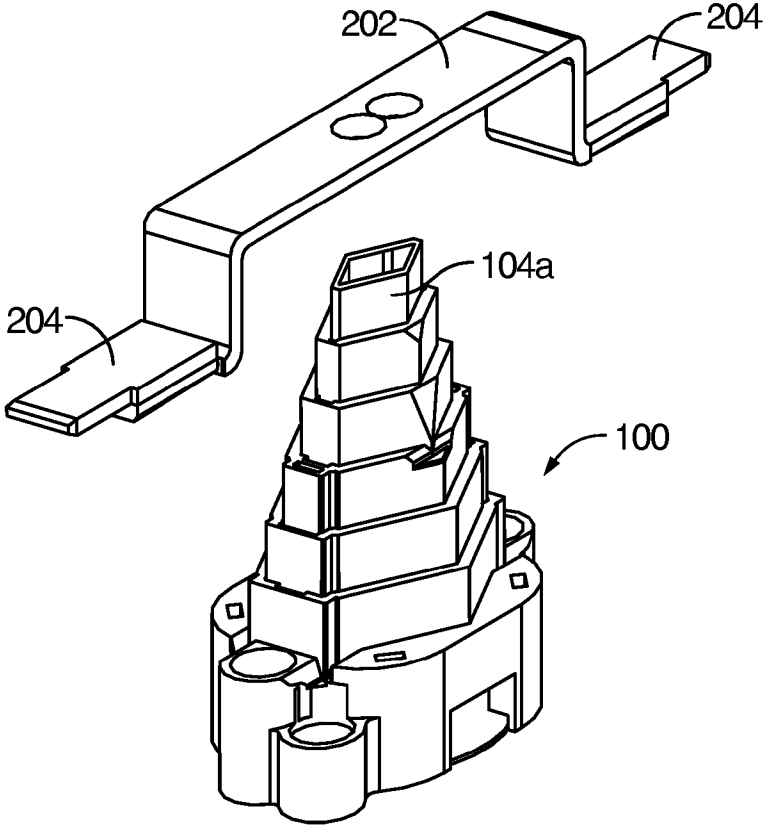
FIG. 18 is a perspective view of a portion of the flat presser rail assembly of FIG. 17, showing a mounting bracket disconnected from the flat presser.
Figure 19:
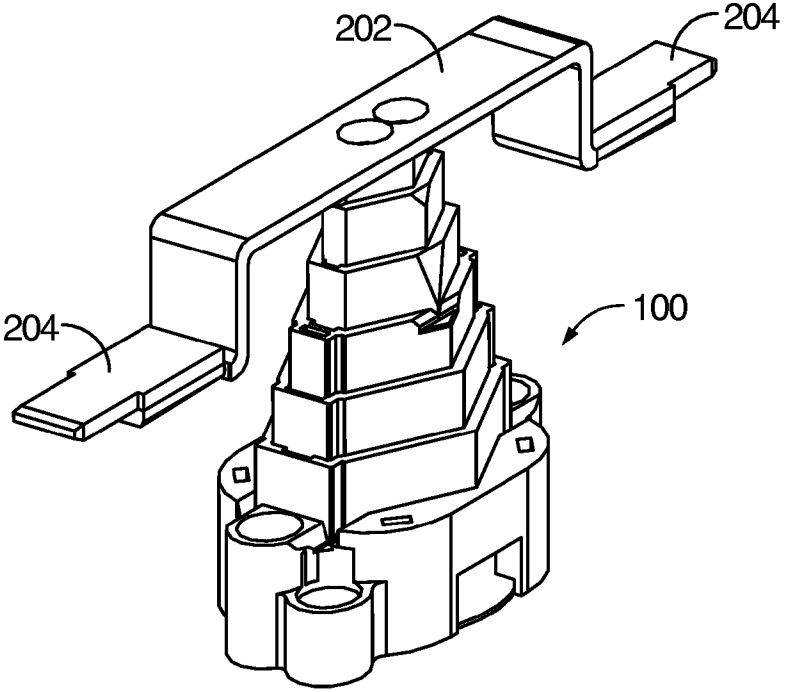
FIG. 19 is a perspective view of a portion of the flat presser rail assembly of FIG. 17, showing the mounting bracket connected to the flat presser.
Figure 20:
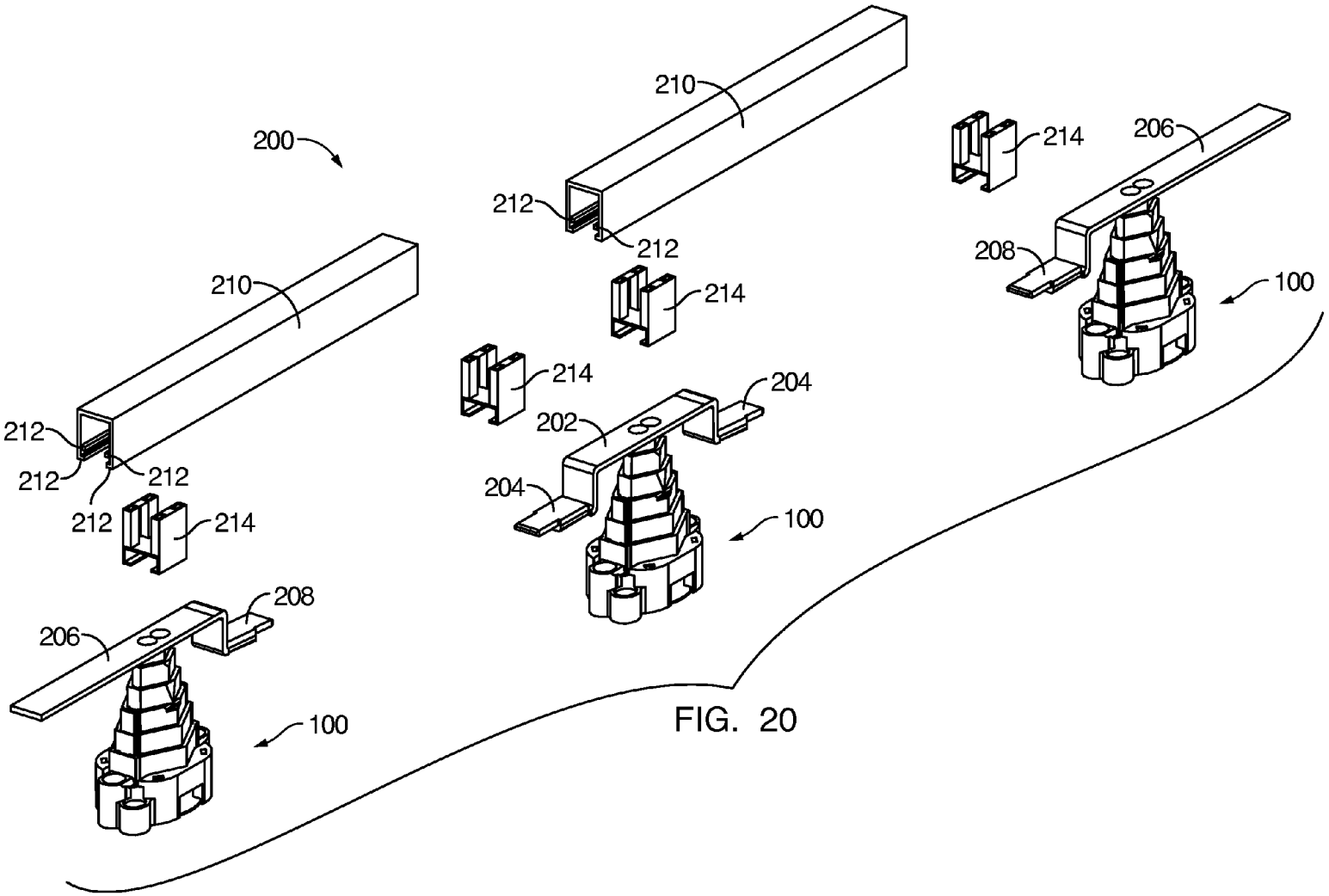
FIG. 20 is a perspective, exploded view of the flat presser rail assembly of FIG. 17.

With specific reference to FIG. 17, the flat presser rail assembly 200 includes a plurality of flat pressers 100 with the elastomeric cap 106 not included or removed. In the preferred embodiment, the assembly 200 utilizes three linearly spaced flat pressers 100. A center rail mounting bracket 202 is secured to the distal end of wall section 104*a* of the middle flat presser 100. The center rail mounting bracket 202 is generally U-shaped and has a plurality of outwardly extending arms 204, as best shown in FIGS. 18-20. Similarly, end rail mounting brackets 206 are secured to the distal ends of walls sections 104*a* of the respective end flat pressers 100. The rail mounting brackets 206 are generally L-shaped and have an arm 208 extending towards the middle flat presser 100. The rail mounting brackets 202, 206 may be attached to the respective flat pressers 100 by means known in the art, such as by fasters and the like. In an embodiment, the mounting brackets 202, 206 may be secured to the flat pressers 100 by means similar to how the elastomeric cap 106 is secured, i.e., friction fit.

Figure 21:
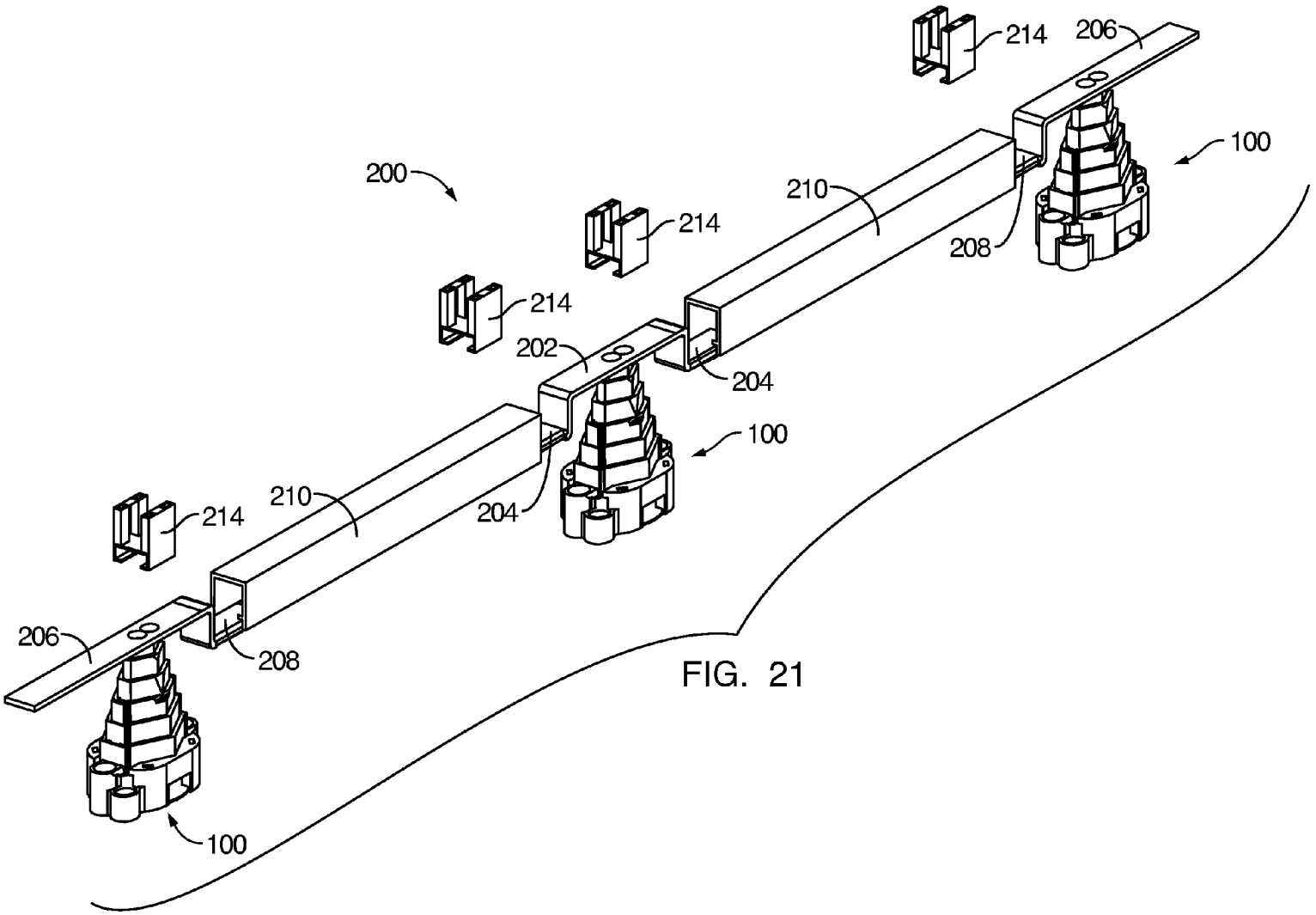
FIG. 21 is a perspective, exploded view of the flat presser rail assembly of FIG. 17 in a partially assembled state.

As best shown in FIGS. 20 and 21, the flat presser rail assembly 200 further includes presser rail sections 210. The presser rail sections 210 are preferably formed from a durable material such as extruded aluminum or the like, although other materials are certainly possible without departing from the broader aspects of the present invention. The presser rails 210 each include a pair of guide rails 212 defining a channel therebetween for slidably receiving arms 204, 208 of the mounting brackets 202, 206. FIG. 21 illustrates the arms 204, 208 received in presser rails 210. A plurality of retaining clips 214 are also included and enclose the remaining space between the presser rails 210 and the mounting brackets 202, 206. As shown therein, the retaining clips 214 snap over a portion of the arms 204, 208 of the mounting brackets 202, 206. Referring back to FIG. 17, the presser rails 210 and the mounting brackets 202, 206 form a generally planar presser surface. As with the flat pressers 100 discussed above, presser assembly 200 may be flush mounted to the underside of a support board of a male blanking tool by screws or other means known in the art.

In operation, the flat presser rail assembly 200 is surface mounted to the bottom of a support plate, such as support plate 24 shown in FIGS. 3 and 4 in a predetermined location. Under the bias of the conical spring 110, the flat pressers 100, and thus the presser rails 210, are in an extended position away from the under surface of the support board 24. As the blanking tool 20, and thus the support plate move downwardly, the planar surface of the presser assembly 200 defined by the presser rails and the mounting brackets 202, 206 engage the top surface of the sheet 12 of paper material and the flat pressers 100 retract/collapse in the manner described above. The presser members 22A-E then push the blanks 26A-E from the sheet 12, and thereafter, the blanking tool 20, including support plate 24 then moves upwardly to its initial starting position wherein the flat pressers 100, and thus the flat presser rail assembly 200, again return to their fully extended positions.

In an embodiment, a shorter flat presser rail assembly may be constructed using two end flat pressers. Similarly, a longer presser rail may be constructed using two middle and two end flat pressers. Indeed, as will be readily appreciated, a flat presser rail assembly of almost any size may be constructed by using any number of flat pressers 100 and any combination of mounting brackets and presser rails, without departing from the broader aspects of the present invention.

In an embodiment, multiple presser assemblies 200 may be surface mounted to the bottom of the support board. In yet another embodiment, individual flat pressers 100 may be utilized in combination with one or more flat presser rail assemblies 200 to provide an even more tailored support and stabilization system for the sheet of material. In particular, additional flat pressers 100 may be added to the support board 24 to more specifically tailor the presser arrangement to the specific geometry of the carton/packaging blanks.

Although this invention has been shown and described with respect to the detailed embodiments thereof, it will be understood by those of skill in the art that various changes may be made and equivalents may be substituted for elements thereof without departing from the scope of the invention. Particularly, the present invention is not limited to a particular structure and arrangement of the slide components surrounding the extractor mechanism.

In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the above description.

What is claimed is:

1. A blanking tool for making packaging blanks from a sheet of material, said blanking tool comprising:

a female blanker for supporting said sheet of material; and a male blanker having a plurality of presser members secured to a support plate, said male blanker disposed generally above said female blanker and movable towards and away said female blanker to knock said packaging blanks from said sheet, said male blanker further including a plurality of flat pressers surface mounted to an underside of said support plate and projecting downward from said support plate toward said female blanker such that said flat pressers only project from the underside of said support plate, said flat pressers being configured to secure said sheet as said presser members impact said packaging blanks; and wherein said flat pressers each include a plurality of coaxially oriented, concentric wall sections of progressively smaller size and smaller interior areas, said wall sections being collapsible from an extended position wherein said wall sections partially overlap in an axial direction to a collapsed position wherein each of said wall sections substantially completely overlap in said axial direction such that each of the wall sections not having the largest interior area among the plurality of wall sections are substantially entirely nested within the wall section having the largest interior area, a base member having at least one vent aperture formed in a sidewall thereof, the base member being dimensioned to receive the wall sections in a nested configuration such that each of the wall sections is substantially entirely nested within the base member and substantially does not protrude from the base member in the axial direction when in the collapsed position, and a biasing mechanism for biasing said wall sections to said extended position.

2. The blanking tool of claim 1, further comprising:

an elastomeric member secured to one of said wall sections and defining a distal end of said flat presser, said elastomeric member contacting said sheet as said presser members impact said packaging blanks.

3. The blanking tool of claim 1, wherein:

said biasing mechanism is a conical spring, said conical spring being disposed in a cavity defined by said wall sections when in said extended position.

4. The blanking tool of claim 1, wherein:

wherein each of said wall sections is diamond in shape.

* * * * *